United States Patent [19]

Elliott et al.

[11] 4,198,289

[45] Apr. 15, 1980

[54] MOBILE, WATERLESS, COAL AND MINERAL SEPARATING METHOD

[76] Inventors: Guy R. B. Elliott, 103 Grand Canyon Dr., Los Alamos, N. Mex. 87544; Milton W. McDaniel, P.O. Box 488, Cimarron, N. Mex. 87714

[21] Appl. No.: 931,452

[22] Filed: Aug. 7, 1978

[51] Int. Cl.[2] ..... B03B 1/02

[52] U.S. Cl. ..... 209/11; 209/172

[58] Field of Search ..... 209/3, 11, 172, 173

[56] References Cited

U.S. PATENT DOCUMENTS

| | | | |
|---|---|---|---|
| 1,067,410 | 7/1913 | Du Pont | 209/172 |
| 1,106,195 | 8/1914 | Du Pont | 209/172 |
| 2,670,078 | 2/1954 | Davis | 209/172 |
| 3,026,252 | 3/1962 | Muschenborn et al. | 209/11 X |

*Primary Examiner*—Ralph J. Hill

*Attorney, Agent, or Firm*—Paul D. Gaetjens

[57] ABSTRACT

A waterless method of separating minerals and a mobile mineral separator are described in which preheated mine products are continuously separated from associated mine refuse by sink/float washing in a heavy-liquid bath which has been heated to its boiling point. The heavy liquids will usually be halogenated organic liquids or liquid mixtures. The separated product and reject fractions are withdrawn by augers to drainage hoppers where most of the heavy liquids are removed for return to the bath. Final removal of the heavy liquids from the mine products and reject fractions is accomplished by vaporization as the product and the reject fraction move by additional augers through heated pipes. The vaporized heavy liquids are collected in air-cooled or otherwise cooled condensers and are returned to the bath. The heavy liquids are essentially completely recycled.

1 Claim, 3 Drawing Figures

MOBILE, WATERLESS, COAL AND MINERAL SEPARATING METHOD

BACKGROUND OF THE INVENTION

1. Field of the Invention

Mining operations typically remove refuse, or gangue, along with the desired mine products, i.e., coal, ore, or other minerals. The device of this invention is used to separate such refuse from the desired products of the mine. Nine principles underlie this invention: First, the densities of desired mine products usually are different from the densities of the associated refuse components. Second, numerous pure heavy liquids exist which have densities intermediate between the densities of the mine products and of their associated refuse. Other densities can be achieved by mixing pure heavy liquids. Simply by density differences, sink and float fractions can be separated, thereby removing the mine products from the refuse. Third, in a modification of the second concept, where simple sink/float separations are ineffective the heavy liquids can be stirred to suspend one fraction in a liquid of slightly less density while a second, more dense fraction settles. Fourth, these heavy liquids are unable to wet into and fill the pores of solids if the liquids are at their boiling points and the solids are even hotter. Therefore, hot solids with their surfaces cooled to the heavy-liquid boiling point can be readily and essentially completely freed of clinging heavy liquids by drainage plus minor further heating to vaporize remaining liquids. Heating the liquids also assists the drainage because the viscosities and surface tensions of the liquids fall with temperature increases. Fifth, many suitable liquids do have boiling points which can be reached without damaging the products which are sought from mines. Sixth, the great density of the vapors of heavy liquids lets even hot vapors settle in a container of suitable design. Seventh, preheating the product/refuse mixture eliminates moisture which otherwise would (a) interfere with dispersion and separation of the product and refuse in the heavy liquid, (b) lead to metal corrosion, (c) require unnecessary product shipping costs, and (d) with coal, reduce the Btu output per pound of coal burned. Eighth, preheating the mine product, together with the thermal shock as the product enters the cooler bath of heavy liquid, separates product materials from refuse. Such refuse can be particularly undesirable. For example, the thermal shock breaks pyrite particles from coal, and sometimes it breaks the coal along pyrite streaks so that this previously trapped pyrite is exposed and can break off, thereby reducing sulfur in the coal. Ninth, elemental sulfur is dissolved away from coal by many of these heavy liquids.

2. Prior Art

A. "Application of Heavy-Liquid Processes to Mineral Benefication," by L. A. Roe and E. C. Tveter, Society of Mining Engineers Transactions, June, 1963, pp. 141–146. This article reviews the patent literature and processes prior to late 1962 and reports the failure of a coal plant in which 20,000 tons of coal were washed (separated) by heavy liquids, including trichloroethylene. From the standpoints of safety, environment, and economics, this approach to minerals beneficiation would still be unacceptable today. A second plant failed to recover carbon tetrachloride ($CCl_4$) from purified clay. Preheating the clay, as is incorporated in the present invention, would have permitted $CCl_4$ recovery and prevented the failure.

The patent summaries in the article show (a) evaporation recovery of volatile heavy liquids used for parting of mine product and reject fractions, (b) preconditioning of the mine product/refuse mixtures by coating with liquids or solids which are immiscible in the heavy liquids, and (c) the use of continuous conveyors (chains and spiral blades) for removal of the parted mine products and reject. However, these patents do not address the major advantages of predrying and preheating the mine product/refuse mixture to temperatures above the boiling point of the heavy parting liquids as shown in this invention. This preheating permits rapid completion of the heavy liquid recovery by drainage and vaporization; such preheating is essential if one is to operate an efficient, compact, and portable mineral washer (separator) which does not use process water.

B. "Demonstration Plant Test Results of the Otiska Process Heavy Liquid Benefication of Coal," by D. V. Keller, Jr., C. D. Smith, and E. F. Burch, presented to the Annual SME-AIME Conference, Atlanta, Ga, Mar. 7, 1977. This publication describes a large, stationary, pilot plant for separating coal from reject by sink/float separation in a heavy medium.

Because the Otiska people did not recognize the importance of preheating their coal/refuse mixture, they selected a process with major disadvantages. Their paper states that their choice of heavy liquid reflects "two key characteristics," namely that "(1) the heavy liquid does not react significantly with the coal product or reject material, and (2) the liquid permits complete dispersion of the coal product particles throughout the separation bath." To obtain these "key characteristics," they chose a heavy liquid which requires (a) system pressurization, a very difficult engineering problem, (b) refrigerated condensation, a large expense, and (c) coal pretreatment to allow coal particle dispersion, an unreliable process which must be tailored to each specific coal field. In addition, their system still requires heating the fractions, but this heating is done after the parting when the heating is more difficult and when it delays the processing of further material. Finally, the Otiska process is limited to only a very few of the many otherwise possible parting liquids. In the present invention a much simpler separation system is described which can be mounted on trailers and therefore is mobile.

3. Utility

The mineral separator of this invention provides a new method of purifying mine products, i.e., coal, ore, and minerals, from their associated refuse. Mine product/refuse mixtures are found in the new output of mines and in the reject piles from earlier mine and minemill operations. Separation and removal of such refuse from mining operations is necessary or advantageous both for transportation and for later processing and use of the mine products. Furthermore, many old reject piles present environmental hazards yet also contain materials which now would be valuable if they were separated from their associated refuse—there is incentive to reprocess such piles. This invention will provide an economically competitive separation of many such mine product/refuse mixtures. One particularly undesirable component of the refuse in coal mixtures is the sulfur, both elemental and as pyrites. The mineral separator of this invention offers significant removal of these forms of sulfur which are frequently present in coal. The mobility feature of this mineral separator is an especially valuable asset in dealing with old reject piles. Often the amount of valuable resource in such reject piles does not warrant construction of a permanent new mill, yet a mobile unit could move in, reprocess the reject piles, and move one to another site, thereby recovering mine products and reducing environmental problems. The waterless feature of this mineral separator is also important. Water rights which were available for mining in earlier days now in most cases been diverted to other uses. Also many potential mines have had to be abandoned because water was not available. Even where water is now available for mineral processing, water-based mineral processing creates pollution problems which are avoided by the mineral separator of this invention. The simplicity of this mineral separator is also economically important and eliminates many complex operations of some mine mills, e.g., froth flotation, magnetite recovery, filtration, cycloning, and waste settling. The separator of this invention avoids the pressurized operations and refrigeration of the separator discussed in Item B of Prior Art. As a consequence both of the new method of mine product recovery and of the corollary simplification of the equipment required, the equipment of this invention can be cheaper, fewer operators are required, and repairs are easier than for earlier separation equipment.

SUMMARY OF THE INVENTION

A method for recovery of mine products from associated refuse based upon sink/float separations in a heavy liquid bath which is maintained at or near its boiling point is described. The solid mine product/refuse mixture is dried before the separation, and the mixture is maintained at a temperature slightly above the liquid boiling point when the mixture is introduced into the heavy-liquid bath. Under these conditions the mine products can be readily separated by density from the refuse, and the separated fractions can be withdrawn and dried quickly and easily to recover and recycle the heavy liquid. An inexpensive, mobile, mineral separator capable of processing large volumes of material and using the above method is described. The separator comprises one or more trailers on which are mounted a mine product/refuse preheater, flotation baths, drainage and storage hoppers, dryers, air-cooled condensers, and augers and pipes with motors and pumps to move the mine products, rejects, and heavy liquids through the processing cycle. Such heavy liquids are primarily pure or mixed halogenated organics with densities in the range of 1.4 to 1.6 for coal washing (separation) and in the range 2.0 to 4.4 for separation of ores and minerals. However, other heavy liquids are required for special uses.

DESCRIPTION OF THE PREFERRED EMBODIMENT

Figure 1:
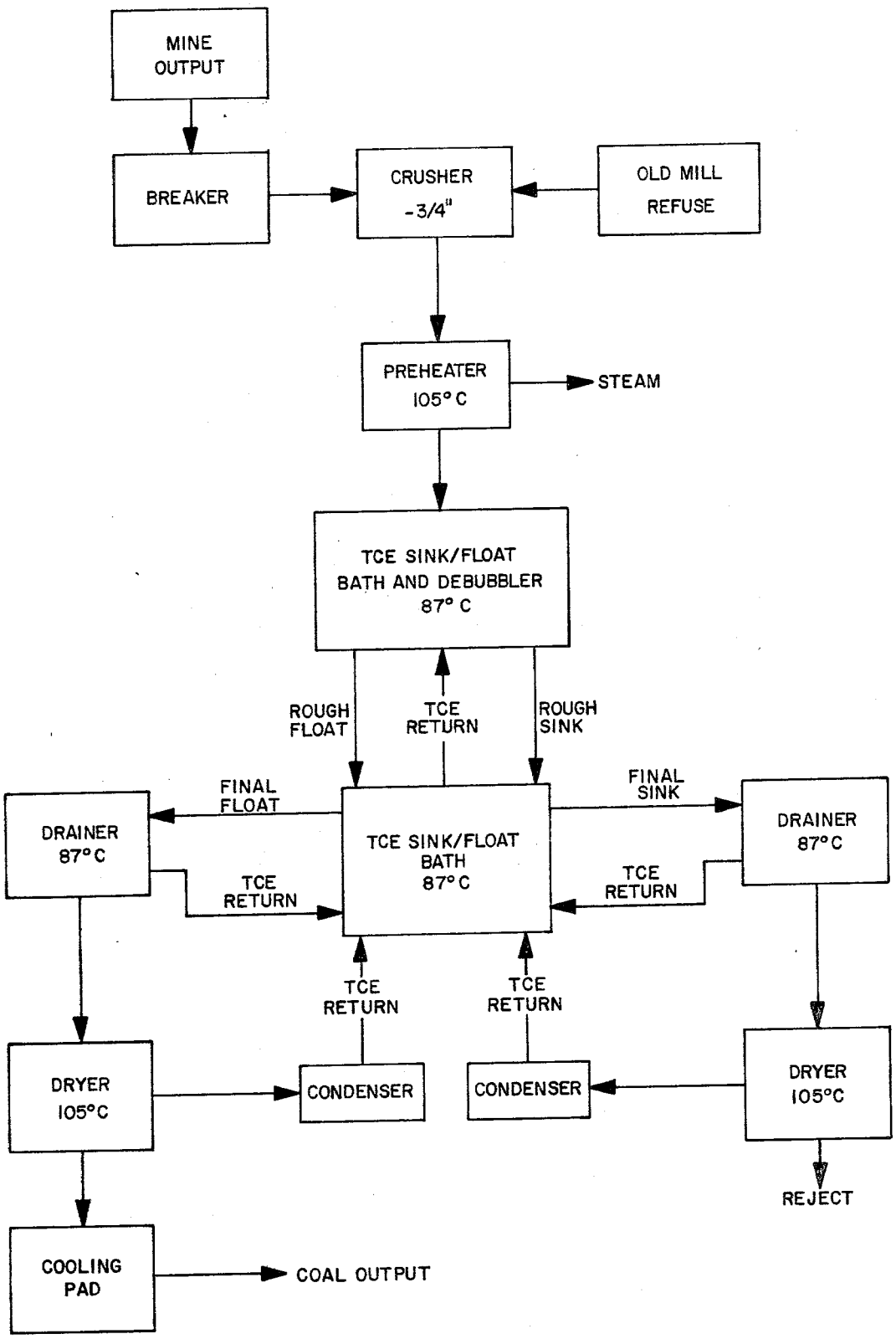
FIG. 1 is a block diagram showing the major steps of the method used with coal processing in the preferred embodiment of this invention.

FIG. 1 presents a block diagram or flow sheet of the method of this invention when used for coal separation. First, coal/refuse mixtures are reduced in size to less than ¼ inch. Breakers and crushers or other standard equipment can be used for this sizing. Next, the crushed coal/refuse mixture moves into a separation system which is usually operated continuously. The coal/-refuse mixture is heated and dried at approximately 105° C. in a hopper. The dried particles at 105° C. move to a trichloroethylene (TCE) bath at its boiling point (87° C.). TCE boiling cools the particle surfaces to 87° C., but the insides of the particles remain dry and above the TCE boiling point. Bubble formation on any particle gradually subsides as the solid surface cools, and by the time the particles reach the augers the particles are quiescent. In this bath a preliminary sink/float separation is accomplished, some elemental sulfur dissolves into the heavy liquid, and some pyrites and other refuse break from the coal due to thermal shocks. The roughly separated sink and float fractions move by separate augers and separately enter a second TCE sink/float bath at 87° C. Here a final sink/float separation occurs. The float fraction (coal) moves to a drainer, then to a dryer, then out to a cooling pad. The TCE vapor from the dryer moves to a condenser. TCE liquid from the drainage and condensation are returned to the two TCE baths. The sink fraction (reject) follows a drying and TCE-recovery pattern like that used for the float fraction.

Figure 2:
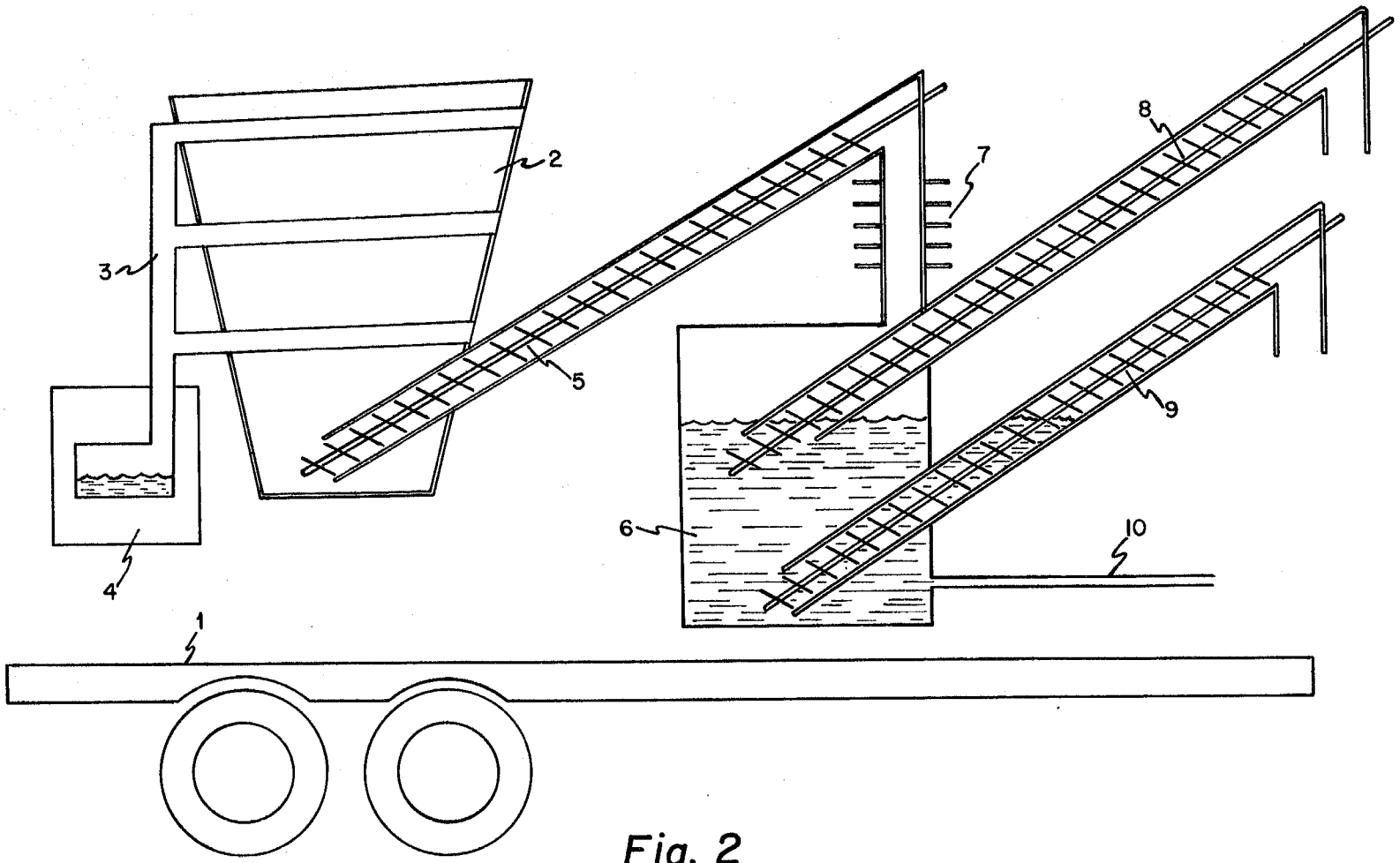
FIG. 2 is a schematic view showing a portion of the device mounted on one of two trailers using the method of this invention.

FIG. 2 shows a portion of the device mounted on a first trailer when used for coal washing. Trailer 1 holds a hopper 2 into which is put the coal/refuse mixture. The mixture is heated through heating pipes or heat pipes 3 which are fired by burner 4. Dried coal/refuse is drawn by auger 5 to TCE bath 6. TCE vapors from bath 6 are collected at air-cooled condenser 7. Preliminary separations of floated coal and sunken reject move out of the bath by respective augers 8 and 9. Recovered TCE liquid is pumped back to bath 6 through inlet pipe 10.

Figure 3:
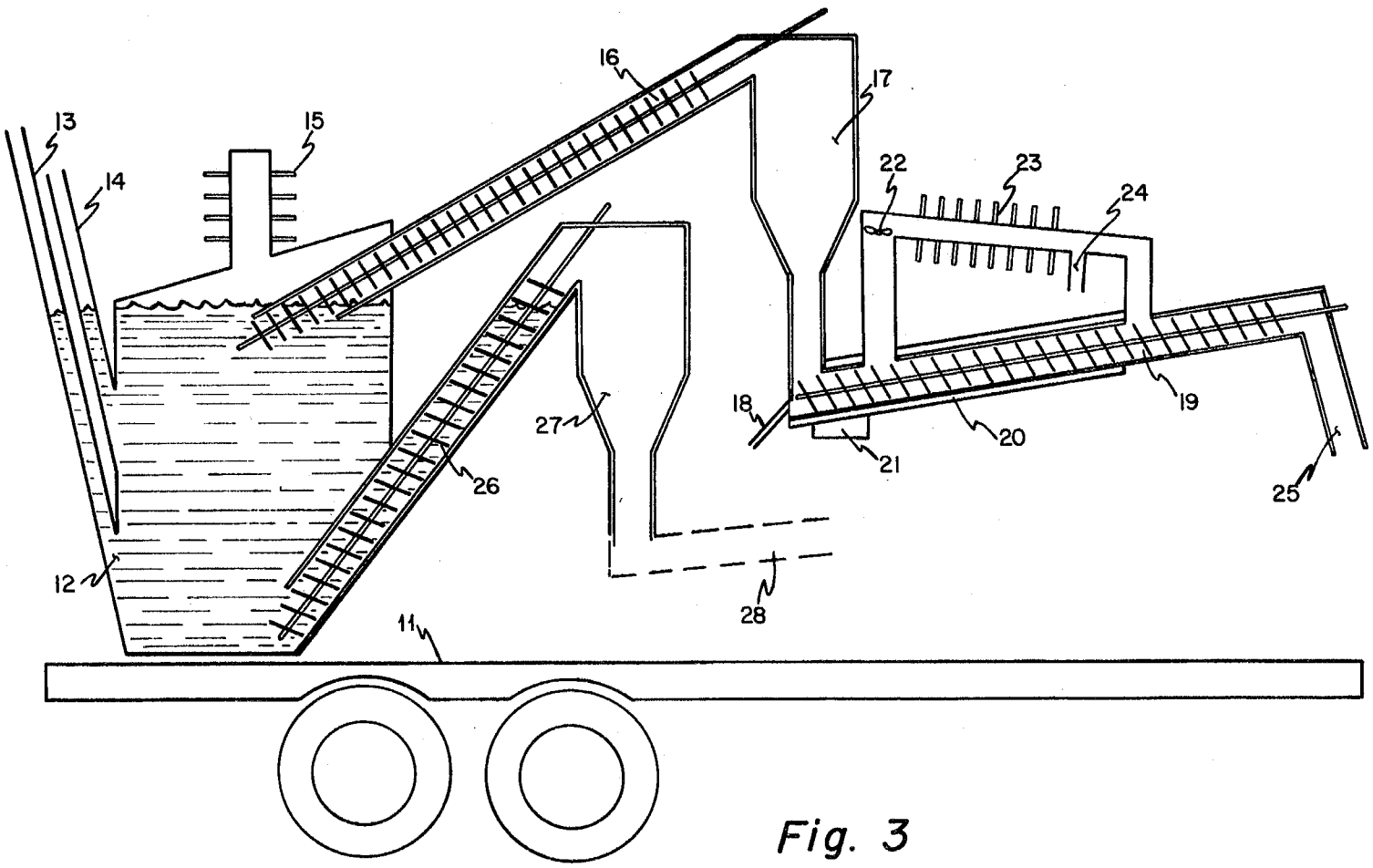
FIG. 3 is a schematic view showing the remainder of the device mounted on the second trailer using the method of this invention.

FIG. 3 shows the remainder of the device mounted on a second trailer 11. Partially separated sink and float fractions of the original coal/refuse mixture enter TCE bath 12 by respective pipes 13 and 14. These pipes 13 and 14 are connected respectively to auger pipes 9 and 8 in FIG. 2. TCE vapor from bath 12 is collected at air-cooled condenser 15. Auger 16 withdraws floated coal fraction material from bath 12 to drainage hopper 17. Drained TCE is pumped back to baths 12 and 6 through pipe 18 which is connected to pipe 10. The coal fraction moves by auger 19 through heated pipe 20. Pipe 20 is heated by heater 21. TCE vapors move by fan 22 to air-cooled condenser 23. Liquid TCE returns to baths 12 and 6 through pipe 24. Dried coal product moves out pipe 25. A similar path (not completely shown) is follo ved for the sunken reject. Auger 26 withdraws this reject to drainage hopper 27 and to items listed as 28 but containing the analogs of items 18 to 25. Again the TCE is essentially completely recycled and a dried reject is delivered for removal.

The preferred embodiments for ore and mineral separation usaully contain all the features discussed for coal, but the heavy liquids and the operating temperatures are different. Also the dimensions of the various components are changed.

OPERATION PARAMETERS

Different liquids are appropriate for different mine products. First consider coal recovery. In this invention trichloroethylene (abbreviated TCE) was selected for such coal recovery. TCE with a density of about 1.46 will float coal particles with ash contents up to about 17%. Typical bituminous coals, when floated on TCE, yield a product with average ash content of about 7%; the reject typically is around 60% to 80% ash. Preheating the coal/refuse mixture to 105° C. boils off the entrapped moisture. When these heated particles are fed to TCE in a separation (washing) bath maintained at about 87° C. by the boiling TCE, the particle surfaces cool, but the inner regions of the particles remain hot enough to vaporize any entering TCE, and they block any tendency to entrap TCE in their fractures and pores. This temperature gradient further fractures the coal, exposing more coal surface and breaking and eliminating dense, undesirable inorganic materials such as pyrites, thereby reducing the sulfur content of the coal. The floated coal and the sunken reject are withdrawn by augers, washed a second time in TCE (optional), drained, then drawn with augers through hot pipes which dry the coal and the reject fractions by reheating their surfaces above the TCE boiling point. All the TCE is returned to the bath as condensed or drained liquid. The coal is air cooled before piling to prevent spontaneous combustion which might otherwise result from the heating.

If one wishes to carry out his coal separation at a density different from that of pure TCE, he can mix the TCE with other materials, or the TCE can be replaced. For example, a density of about 1.50 could be achieved by mixing the TCE with about 16% of iodopropane (density 1.71, boiling point 90° C.). Other densities can be derived from other compositions.

As a second and similar embodiment of the method of this invention, galena (lead sulfide, density 7.6) is separated from its refuse (density near 2.5). In this case one selects a heavier liquid, e.g., carbon tetrabromide ($CBr_4$, density 3.42, boiling point 190° C.) in which the galena will sink and the reject will float. Here the galena/refuse mixture may be heated to about 200° C. before feeding it to the bath. Or, alternatively, the vaporization and recovery of the $CBr_4$ is assisted by a sweeping current of hot air as the augers move galena and the reject up their respective pipes.

A final type of separation method, again of galena and refuse, can be examined. Here dibromomethane ($CH_2Br_2$, density 2.50, boiling point 99° C.) is used to float reject from the galena. The sink/float operation is carried out at about the boiling point of $CH_2Br_2$. Now the $CH_2Br_2$ bath is vigorously stirred so that the floatable and the nearly floatable material of the reject are delivered to one auger while the galena particles sink and move to the other auger. $CH_2Br_2$ recovery is similar to the recovery of TCE, as discussed above.

On the basis of pilot plant tests of the device of this invention, a full scale device mounted on two trailers would process over 150,000 tons of coal-containing material per year. A usual coal product from virgin mine output of bituminous coal will be essentially dry, will contain about 7% ash, and will have a heating value of about 13,000 Btu per pound of coal. Sulfur removal depends on the nature of the sulfur, but the device of this invention will remove from 25% to 50% of the sulfur.

The foregoing examples are not intended in any way to limit the scope of the invention but rather are presented for the purpose of meeting the enablement and best mode requirements of 35 U.S.C. 112. The scope of the invention is as set forth in the Summary of the Invention and the broad claims appended hereto.

What we claim is:

1. A waterless method for separating mine products from refuse comprising:

(a) a single-phase heavy-liquid bath maintained at or near its boiling point, with the heavy liquid comprised of pure compounds or mixtures, (b) a dried solid mixture of mine products and refuse which is maintained at a temperature slightly above the boiling point of the heavy liquid, (c) introducing the mixture of mine products and refuse into the bath wherein the outer surfaces of the mine products and refuse will evaporatively cool to the heavy-liquid boiling point and wherein a sink/float separation of mine products and reject will take place, (d) separately removing the mine products and the reject from the bath, (e) drainage of the mine products and the reject at a temperature near the boiling point of the heavy liquid, (f) further heating of the mine products and the reject to boil off small amounts of heavy liquid which may remain after the the drainage, (g) condensing any vaporized heavy liquid, (h) returning drained and condensed heavy liquid to the heavy liquid bath, and (i) delivering separate dry streams of product and reject.

* * * * *